US005291640A

United States Patent [19]

Rise

[11] Patent Number: 5,291,640

[45] Date of Patent: Mar. 8, 1994

[54] LOOP ATTACHMENT FOR TENTS AND COVERS

[76] Inventor: Leif Rise, 7748 Westlaen Ave., Los Angeles, Calif. 90045

[21] Appl. No.: 919,758

[22] Filed: Jul. 27, 1992

[51] Int. Cl.[5] ..... A44B 21/00

[52] U.S. Cl. ..... 24/464; 24/714.7; 24/559

[58] Field of Search ..... 24/115 K, 464, 465, 24/477, 480, 559, 714.7

[56] References Cited

U.S. PATENT DOCUMENTS

| | | | |
|---|---|---|---|
| 824,332 | 6/1906 | Barnum | 24/464 |
| 3,139,662 | 7/1964 | Barton . | |
| 3,422,504 | 1/1969 | Brown . | |
| 3,597,812 | 8/1971 | Allan | 24/464 |
| 3,780,400 | 12/1973 | Hinperger . | |
| 4,184,233 | 1/1980 | Jacobson . | |
| 4,534,089 | 8/1985 | Swan . | |

*Primary Examiner*—James R. Brittain
*Attorney, Agent, or Firm*—William H. Maxwell

[57] ABSTRACT

An article of flat pattern form providing a loop disengageably attached to a margin of flexible sheet material by manipulating a male member at one end of a strap and through a smaller opening of a female member at the other end of the strap, with a section of the flexible sheet material over the male member, by bending and twisting for passage of the male member through the female member, enabled by an adjoining access opening, followed by untwisting and with the male member overlying a peripheral portion of the female member and the flexible sheet material secured by bites over the inner edge of the female opening and over the periphery of the male member.

8 Claims, 2 Drawing Sheets

LOOP ATTACHMENT FOR TENTS AND COVERS

BACKGROUND OF THE INVENTION

This invention relates to the securement of fabrics and like sheet materials such as are used in tents and covers and the like. For example, tents and covers have been fabricated with marginal ties, straps, cords and loops sewn into or otherwise permanently secured to the fabric or sheet material. Thus, their placement is inflexible and often not useable, since there are many situations that involve obstructions or voids at a particular anchor place. Furthermore, the inclusion of anchor means into the fabric or sheet material is costly and subject to damage, failure and deterioration, and ultimate inoperability. Therefore, it is a general object of this invention to provide a supplement to and a replacement for the prior art anchor means, and in the form of a strap that is attachable by manipulation to establish a loop secure to the fabric or sheet material of a tent or cover and the like.

The anchor means for tents and covers are located along the edges of and at the corners of the fabric or sheet material thereof. These edges are normally protected with a hem, and reinforced with one or more layers of fabric or sheet material so as to distribute pulling forces of an anchor member attached thereto, such as a grommet or eyelet, or strap, or cord and the like. That is, the prior art anchor means have been permanently sewn into or otherwise secured to the marginal portions of the tent or cover formed of fabric or sheet material (plastic). It is an object of this invention to eliminate the permanency of anchor means and replace the same with an anchor of loop configuration that can be selectively attached wherever required along the marginal portions or at the corners of a tent or cover.

Heretofore, attachments of the type under consideration have involved a multiplicicty of parts and securement techniques, it being an object of this invention to reduce this anchor to a single monolithic article characterized by austere simplicity and fabricated of inexpensive durable materials. In practice, this anchor is an article fabricated of flat sheet plastic which is pliable so as to be manipulated by bending and twisting without any damage thereto, being manipulated into loop configuration as shown and later described. This article is characterized by a strap with opposite end male and female formations that are releasably locked together by manipulation with the marginal portion of the tent or cover captured thereby for attachment. It is an object of this invention to provide male and female configurations that establish a secure and releasable attachment that can be employed as an anchor for securement to tents and covers, all as circumstances may require.

It is also an object of this invention to provide a universal loop attachment for fabrics and sheet materials, for example to secure wiping clothes, towels, wash rags, flags, drapes, awnings and any like panel. Among these panels are tarps and protective sheeting for covering stored vehicles and furnishings of all kinds. It is significant that each situation has its peculiarities with respect to placement of these Loop Attachments, all as circumstances may require.

SUMMARY OF THE INVENTION

The article herein disclosed is in the nature of a flexible strap that is engaged end to end over a marginal portion of a tent panel or cover made of fabric or like sheet material. The strap ends are enlarged male and female members adapted to have releasably locked engagement with a layer of fabric or pliant sheet material captured thereby. A feature of this Loop Attachment is that the exterior of the male member is larger than the interior of the female member through which it is passed by providing an adjoining opening through which the strip is turned in order to capture the male member at one side of the female member and with the strap looped at the other side of the female member.

The female interior and adjoining opening form a keyhole through which the larger male member is passed by twisting the strap and thereby turning the male member and adjacent strap end 90° for passage through the keyhole. Said adjoining opening is at the joinder of the female member to the strap end integral therewith, whereby the looped male end inherently trains through the said adjoining opening which is sufficient in size for turning of the strap therein.

A feature of this invention is that there is clearance within said adjoining opening and the opposite side edges of the strap to accomodate a thickness of the pliable tent or cover fabric, or sheet material such as plastic. It is to be understood that the tent and/or cover fabric materials are generally flexible, and therefore pliant and supple, so as to be warped and stretched over the male member and through the female member interior and adjoining opening. Such tent and cover materials have substantial elasticity. However, the Loop Attachment body material is preferably a plastic solid which though flexible and pliable, retains its general initial configuration when bent and twisted by manipulation from its initial flat form and into its useful looped formation.

The foregoing and various other objects and features of this invention will be apparent and fully understood from the following detailed description of a typical preferred form and application thereof, throughout which description reference is made to the accompanying drawings.

THE DRAWINGS

FIG. 1 is a perspective view of the Loop Attachment of the present invention secured to a marginal portion of a tent panel or the like.

Figure 6:
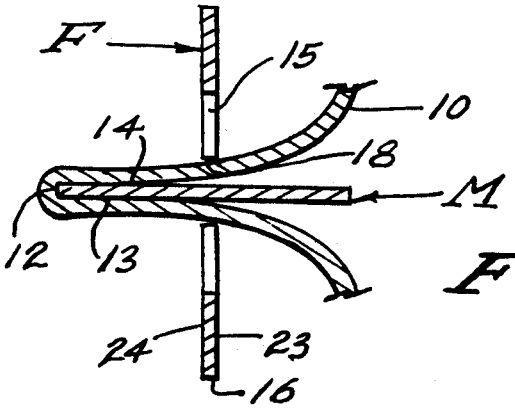
Figure 7:
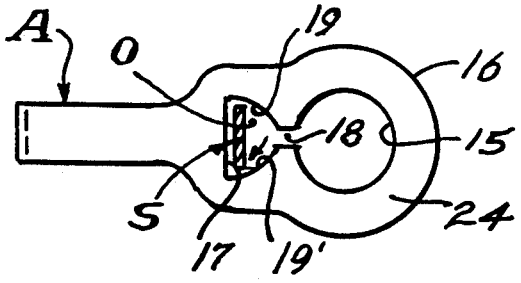

And, FIG. 6 is a sectional view showing a sheeting panel wrapped over the turned end member, after which the strap portion is returned to its normal plane, within the aforesaid adjoining opening to the female member interior, as shown in FIG. 7, as the third step of attachment.

PREFERRED EMBODIMENT

Figure 3:
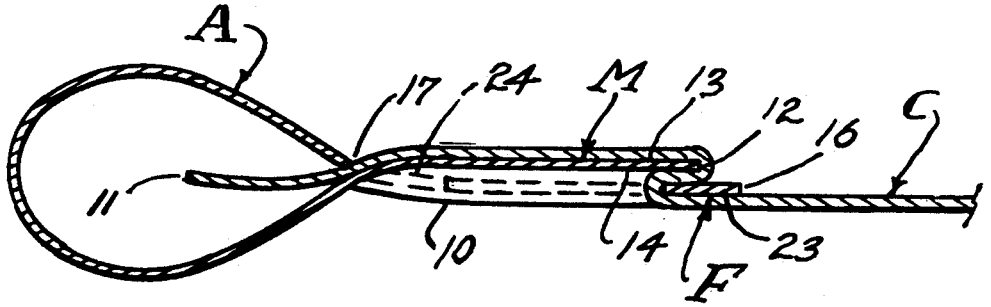
FIG. 3 is a sectional view taken as indicated by line 3—3 on FIG. 1.

Referring now to the drawings, the Loop Attachment A is shown attached to a marginal portion 10 of sheet material cover C, said material being a flexible fabric or plastic sheeting adapted to be folded as shown. The marginal portion 10 has an edge 11 that passes through a loop formed by a thin body as shown in FIG. 3 with a section of the marginal material passing through a female member F at one end of the body and over a male member M at the other end of the body. A feature of this body is its flexibility and the larger male member that passes through the smaller female member, made possible by an adjoining access opening O that accomodates a strap S of the article adapted to turn therein when revolved from the position shown in FIG. 5 to that shown in FIG. 7. Note that the male member M passes through the female member F as shown in FIG. 6, after which the strap S is inherently guided by the access opening through the female member as shown in FIG. 3.

Figure 2:
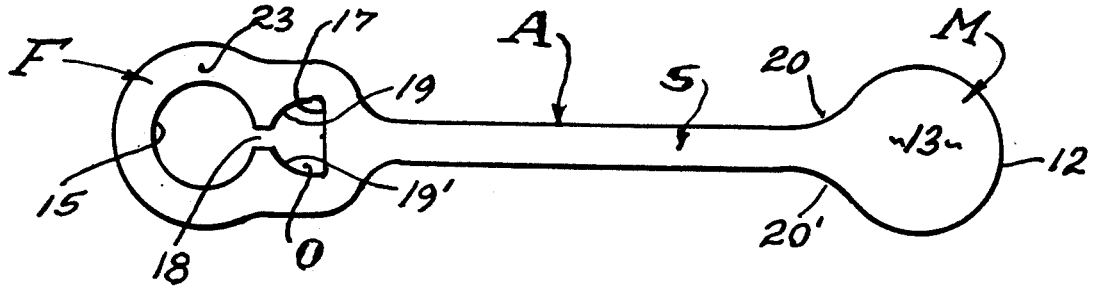
FIG. 2 is a plan view of the Loop Attachment as it is initially formed.

This Loop Attachment article A is integrally formed as shown in FIG. 2 and comprised of a straight elongated strap S with an enlarged male member M at one end and an enlarged female member F at the other end. In practice, this article is die-cut from plastic sheet material, for example 0.035 inch thick, and for example of flexible polyethelene or the like. The material used is pliable and such that it can be bent and twisted by manipulation as shown and described. A typical stap S is 5/16 inch wide and 3 inches long, with the male member M projecting 1 inch at one end, and the female member F projecting 1½ ench at the other end. The portions S, M and F are integrally formed of one body of flat flexible material.

The male member M can vary in plan form and is preferably of round configuration 1 inch in diameter, integral with the strap S as shown and characterized by a smooth semi circular periphery 12 and with flat top and bottom faces 13 and 14.

The female member F can also vary in plan form and is preferably of semi circular configuration with a round interior opening 15 sustantially smaller in size or diameter than that of the male member M. The female member F has a peripheral portion to underly the periphery of the male member and preferably with a semi circular periphery 16 substantially greater in diameter than that of the male member, all as shown throughout the drawings. Like the male member, the female member has flat top and bottom faces 23 and 24.

Figure 5:
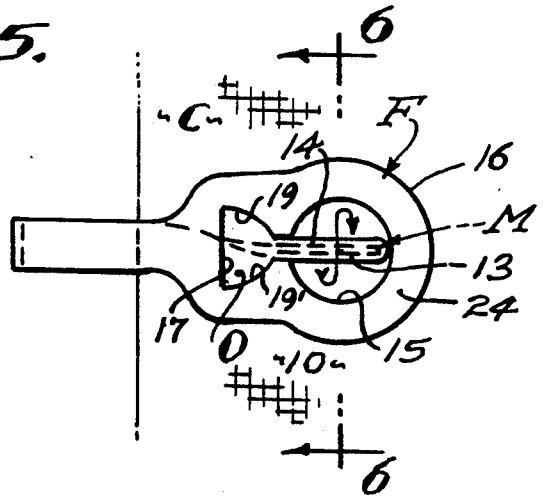
FIG. 5 is a plan view showing the second step of attachment.

In accordance with this invention the access opening O is provided so as to extend the diametral width of the interior opening 15 of the female member F, functionally to pass the diameter of the male member M inclusive of a thickness of the cover C material (see FIG. 5). Accordingly, the access opening O has a straight side 17 normal to a radius line drawn from and spaced from the center of opening 15, and extending transversely of the strap S to form an end thereof and over which the other end portion of the strap is engageably guided when in the looped configuration as shown in FIGS. 3 and 7. A feature is the narrow passage 18 between the female opening 15 and the access opening O, by which they are in open communication one with the other through a necked region (as shown).

In carrying out this invention, the access opening O enables turning or twisting of the strap S (see FIG. 5). Accordingly, there is clearance at either side of opening O for turning of the strap S right or left handedly, from the twisted condition shown in FIG. 5 to the normal use condition shown in FIG. 7. Assuming that the access opening O is triangular as it is generally shown, the sides 19 and 19' opposite the two corners of side 17 are arcuately concaved so as to permit either edge of the strap S to turn in said opening, with clearance for the cover material as is indicated. The cover material is not shown in FIG. 7.

Figure 1:
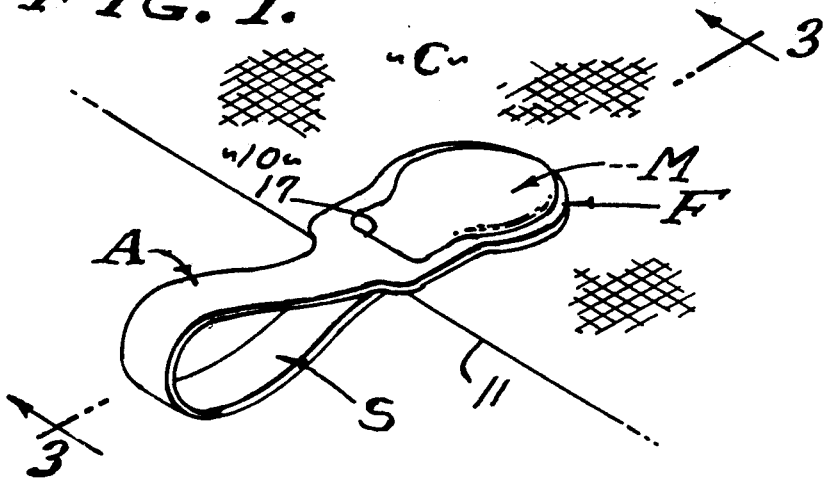
Figure 4:
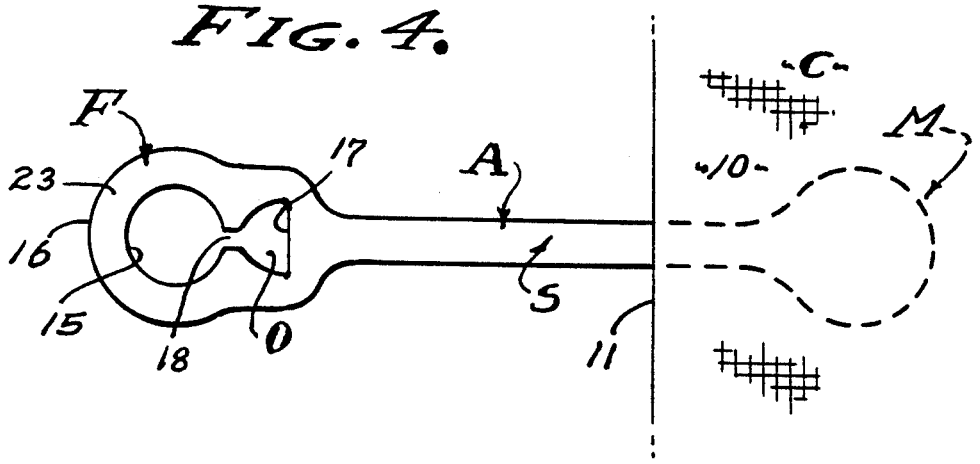
FIG. 4 is a plan view showing the first step of attachment.

The in-use condition of this Loop Attachment is shown in FIGS. 1 and 3 of the drawings, acquired as follows: The initial flat pattern article of FIG. 2 is first placed partially beneath a marginal edge or corner portion of the fabric or sheet cover C, to be secured by the loop established as shown (see FIG. 4). In practice, the marginal portion of the cover C completely overlies the top face 13 of the male member M, and partially overlies the adjoining end of the strap S. Secondly, the strap S is bent upwardly and backwardly as shown in FIG. 5, so that the adjoining female member F overlies the male member M that is beneath the cover margin. That is, the female opening 15 is aligned with the male periphery 12. Thirdly, the underlying male member M is twisted 90° as shown in FIG. 5, and the cover C is pinched over the top and bottom facess 13 and 14 and passed through the female opening 15 and access opening O which are openly joined by the passage 18, as shown in FIG. 6. And, fourthly, the male member M is permitted to untwist as shown in FIG. 7, so that the strap S lies in flat guided engagement with the side 17 of opening O, and with the cover material therebetween as shown in FIG. 3. Note that a section of the cover C overlies the top face 13 of the male member M and that the marginal portion and edge 11 of the cover enters into the loop formed by the strap S.

A feature of the passage 18 at the adjoining openings 15 and O is its opposed biting engagement into the cover material. Locking engagement with the cover material is established by the circular overlap of the male member M over the female member opening 15 and peripheral bottom face 24 thereof, the female member having been turned over as clearly shown in FIG. 3. Accordingly, a double bite is formed by the cover material turned sharply over the opening 15 and periphery 12, a locking engagement being established that is increasingly effective when tension forces are applied through the strap loop to the cover material. The aforesaid biting engagement of the passage configuration with the cover material is achieved by the closely opposed sides of said passage that present points that bury themselves into the surface of the cover material. Additionally, the semi circular periphery 12 of the male member M is joined to the opposite side edges of the strap portion S by radiused fillets 20 and 20' that tangentially spread to have a wedge action in opposition to the outer tangent points of sides 19 and 19' at the corners thereof with the straight edge 17. When tension is applied to the Loop Attachment the sheet material passing through the access opening O at said side corners, forcefully wedges the sheet material therein. Disengagement is by a reverse manipulation of the foregoing process of attachment.

Having described only the typical preferred form and application of my invention, I do not wish to be limited or restricted to the specific details herein set forth, but wish to reserve to myself any modificaitons or variations that may appear to those skilled in the art as set forth within the limits of the following claims.

I claim:

1. A loop for disengageable attachment to a marginal portion of flexible sheeting material, and including;

a flat body of bendable and twistable material having an elongated strap portion with a male member at one end and a female member at the other end, the female member having a first opening therethrough smaller than the male member, and there being a second access opening through the female member and adjoiningly open to the first opening through the female member by means of a passage with parallel longitudinally extending sidewall and narrower than either the first opening or the second access opening through the female member and with clearance for acting as a means for receiving and guiding a twisted position of the male member and sheeting material, whereby the flexible sheeting material overlying the male member can be twisted therewith and the strap portion bent upwardly and backwardly to position the female member over the underlying male member, the male member and sheeting material being passed upwardly through the first opening and the second access opening in the female member and thereafter untwisted to overlie a peripheral portion of the female member with the sheeting material secured by a bite therebetween.

2. The loop for disengageable attachment of flexible sheeting as set forth in claim 1, wherein the strap portion and male and female members are integral in said body.

3. The loop for disengageable attachment to flexible sheeting as set forth in claim 1, wherein the male member is of circular configuration and the first opening in the female member is round and of smaller diameter than the male member.

4. The loop for disengageable attachment to flexible sheeting as set forth in claim 3, wherein the female member has a peripheral portion underlying the perimeter of the male portion.

5. The loop for disengageable attachment to flexible sheeting as set forth in claim 3, wherein the second access opening has a straight side spaced from a center of the first opening through the female member and of a width to receive and guide the strap with clearance for the sheeting material over said strap portion.

6. The loop for disengageable attachment to flexible sheeting as set forth in claim 5, wherein the second access opening through the female member is of generally triangular form with a side opposite each of two corners of the straight side and with clearance for twisting of the strap portion and sheeting material thereover.

7. The loop for disengageable attachment to flexible sheeting as set forth in claim 5, wherein the second access opening through the female member is of generally triangular form with a concaved side opposite each of two corners of the straight side and with clearance for twisting of the strap portion and sheeting material thereover.

8. The loop for disengageable attachment to flexible sheeting as set forth in claim 1, wherein the second access opening through the female member is of a width to pass the strap portion with clearance for the sheeting material over said strap portion.

* * * * *